United States Patent [19]

Junker et al.

[11] Patent Number: 4,506,589

[45] Date of Patent: Mar. 26, 1985

[54] FIRING MECHANISM FOR AUTOMATIC FIREARM

[75] Inventors: Ralph D. Junker, Columbus, N.C.; James R. Helms, Landrum, S.C.

[73] Assignee: Junker Systems, Inc., Tryon, N.C.

[21] Appl. No.: 433,082

[22] Filed: Oct. 6, 1982

[51] Int. Cl.[3] ..... F41D 3/00

[52] U.S. Cl. ..... 89/190

[58] Field of Search ..... 89/168, 176, 190, 182, 89/7

[56] References Cited

U.S. PATENT DOCUMENTS

| | | | |
|---|---|---|---|
| 739,732 | 9/1903 | Sjogren | 89/190 X |
| 943,949 | 12/1909 | Mauser | 89/182 |
| 954,543 | 4/1910 | Ross | 89/176 X |
| 971,061 | 9/1910 | Mauser | 89/190 X |
| 1,387,889 | 8/1921 | Johnston | 89/191 R |
| 1,452,123 | 4/1923 | McCrudden | 89/176 X |
| 2,900,878 | 8/1959 | Nomar | 89/190 X |
| 3,848,510 | 11/1974 | Wolpert | 89/182 |
| 4,172,408 | 10/1979 | Ayler et al. | 89/7 |
| 4,194,433 | 3/1980 | Zellweger et al. | 89/190 |
| 4,213,261 | 7/1980 | Claypool | 89/187 |
| 4,227,439 | 10/1980 | Gillum | 89/190 |
| 4,282,670 | 8/1981 | Junker | 42/16 |
| 4,295,410 | 10/1981 | Patenaude et al. | 89/176 X |

*Primary Examiner*—David H. Brown
*Assistant Examiner*—John E. Griffiths, Jr.
*Attorney, Agent, or Firm*—Burns, Doane, Swecker & Mathis

[57] ABSTRACT

A firearm comprises a barrel having a bore and a receiver forming an ignition chamber. A bolt is slidable in the ignition chamber and includes a striker projection for igniting a primer of the projectile. A bolt advancing mechanism comprises an arm having a first end mounted on the bolt such that a second end of the arm is movable laterally relative to the fore-aft axis. A boss is carried at the second end of the arm. An actuator member is movable in the fore-aft direction relative to the bolt and boss, and includes a first cam surface inclined relative to the fore-aft axis for urging the boss forwardly and laterally. The boss is movable laterally along the first cam surface in response to the boss becoming aligned with a lateral groove in the receiver. Such lateral movement of the boss is in a direction tending to displace the bolt forwardly. The actuator member (i) pushes the boss and bolt forwardly to shift the projectile to a firing position, (ii) cams the boss into the groove to further displace the bolt forwardly and ignite the primer, and (iii) blocks movement of the boss from the groove until ignition occurs, whereupon a second cam surface displaces the boss outwardly.

10 Claims, 12 Drawing Figures

FIRING MECHANISM FOR AUTOMATIC FIREARM

BACKGROUND AND OBJECTS OF THE INVENTION

The present invention relates to firearms and, in particular, to a firing mechanism for a machine gun.

In U.S. Pat. No. 4,282,670 issued on Aug. 11, 1981 to R. D. Junker, there is disclosed an automatic firearm for caseless ammunition in which a bolt is slidable within a firing chamber of a receiver. The bolt has front and rear pockets which, respectively, receive a projectile (e.g., lead slug) and a propellant charge therebehind. The projectile carries a primer, and the front pocket communicates with the rear pocket. The bolt includes a striker projection which performs a two-stage firing operation, viz., initially pushing the projectile into its firing position and thereafter penetrating and igniting the primer. The products of combustion from that ignition are communicated with the rear pocket to ignite the propellant charge and thereby eject the projectile.

It would be desirable to provide a simplified actuating mechanism for advancing the bolt during both stages of the above-described two-stage advancement, while locking the bolt against premature recoiling.

Bolt actuators for firearms are known which include a toggle linkage for advancing a bolt as the toggle linkage is pivoted toward a straightened condition. However, such a toggle linkage requires the use of two arms pivotably interconnected, and steps must be taken to lock the toggle in place. It will be appreciated that in a situation where the bolt carries a striker projection, as disclosed in the above-referenced patent, the firing sequence is directly responsive to the travel of the bolt, as opposed to a situation where firing is produced by a separately actuable firing pin. In the latter case, it is relatively simple to lock the bolt before the firing pin is actuated. Such simplicity does not exist in the former case, however, since the bolt must be allowed to travel right up to the point of ignition. If ignition should occur prior to the locking of the toggle or bolt, the bolt may recoil prematurely.

It is, therefore, an object of the present invention to minimize or obviate problems of the above-discussed sort.

Another object is to provide a novel bolt-locking mechanism.

A further object is to provide a novel bolt-locking mechanism in conjunction with a bolt having an integral firing projectile.

An additional object is to provide such a novel mechanism which drives the bolt forwardly and locks it against premature recoil.

SUMMARY OF THE INVENTION

These objects are achieved by the present invention, one aspect of which relates to a firearm which comprises a barrel having a bore and a receiver connected to a rear end of the barrel and forming an ignition chamber communicating with the bore. A bolt is slidable along a fore-aft axis in the ignition chamber for displacing a projectile into a firing position. The bolt includes a striker projection for igniting a primer of the projectile in response to further forward movement of the bolt relative to the projectile. A bolt advancing mechanism comprises an arm having a first end mounted on the bolt for rotation such that a second end of the arm is movable laterally relative to the fore-aft axis. A boss is carried at the second end of the arm. An actuator member is movable in a fore-aft direction relative to the bolt and boss. The actuator member includes a first cam surface inclined at an acute angle relative to the fore-aft axis for urging the boss forwardly and laterally. The boss is movable laterally along the first cam surface in response to the boss being aligned with a lateral groove in the receiver. Such lateral movement of the boss is in a direction tending to displace the bolt forwardly. A stop surface extends rearwardly from an end of the first cam surface. The actuator member is urged forwardly for pushing the boss and bolt forwardly for (i) pushing the boss and bolt forwardly to shift the projectile to a firing position, (ii) camming the boss into the groove to further displace the bolt forwardly and ignite the primer, and (iii) moving the stop surface into blocking relationship with the boss to block movement of the boss out of the groove.

THE DRAWINGS

The objects and advantages of the invention will become apparent from the following detailed description of a preferred embodiment thereof, in connection with the accompanying drawings in which like numerals designate like elements, and in which:

FIG. 8 is a longitudinal sectional view through the machine gun depicting the feeding of a projectile and propellant charge into the bolt;

FIG. 10 is a cross-sectional view taken along line 10—10 in FIG. 9;

DETAILED DESCRIPTION OF A PREFERRED EMBODIMENT OF THE INVENTION

The accompanying drawings depict the basic structure of a firearm 10 which embodies the principles of the present invention.

Figure 1:
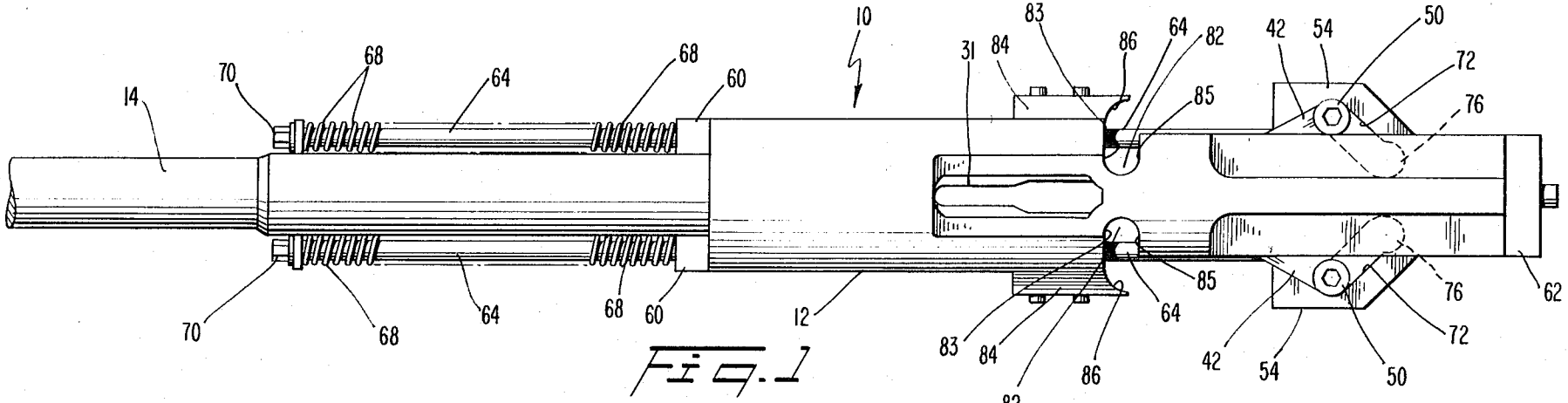
FIG. 1 is a plan view of a machine gun according to the present invention, with the bolt in a retracted or cocked position.

In FIG. 1, there is shown a receiver 12 and a barrel 14 attached thereto. Disposed within the receiver is a central passage 16 (FIGS. 3–5), a front end of which forms an ignition chamber 18 where the primer and propellant of a projectile are to be ignited.

Figure 11:
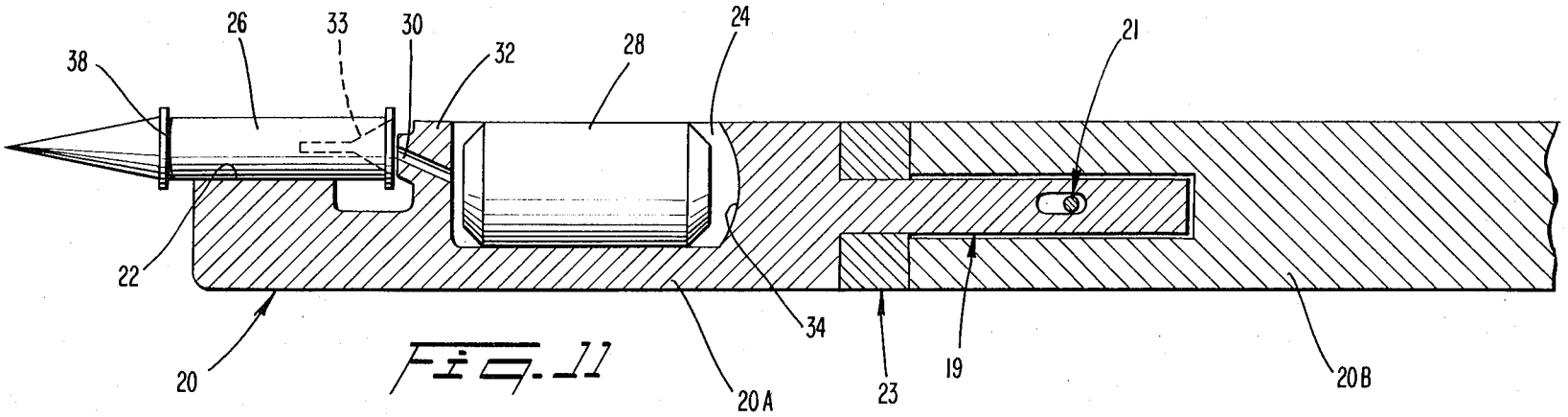
FIG. 11 is a longitudinal sectional view through the bolt.
Figure 12:
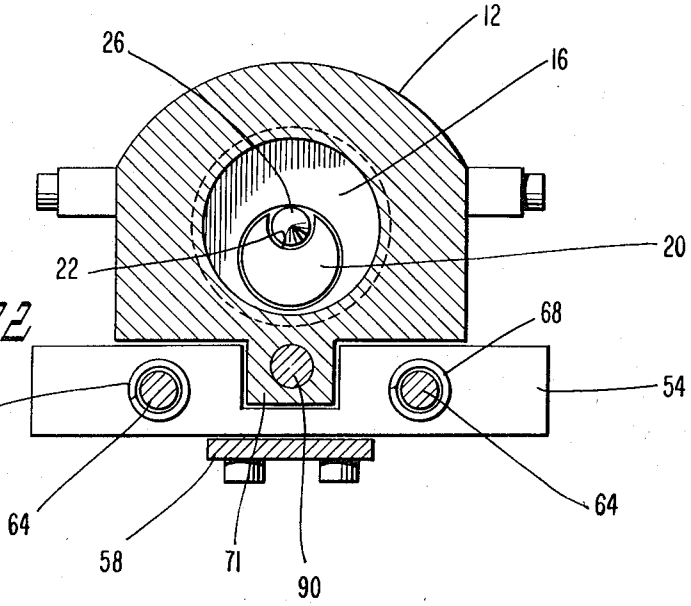
FIG. 12 is a cross-sectional view taken along line 12—12 of FIG. 3.

Slidably mounted within the passage 16 is a bolt 20. The bolt comprises first and second sections 20A, 20B interconnected by a tongue/groove connection 19, with a lost motion (relative play) pin and groove 21. A washer 23 is disposed between the bolt sections 20A,B and expands when compressed, to effect a gas seal. The bolt 20 also includes first and second recesses 22, 24 (FIG. 11) for the reception of a projectile 26 and a propellant charge 28, respectively. The recesses 22, 24 intercommunicate by way of a connecting passage 30. The projectile and propellant charge can be fed-in through an opening 29 (FIG. 8) from a cartridge 31.

Figure 3:
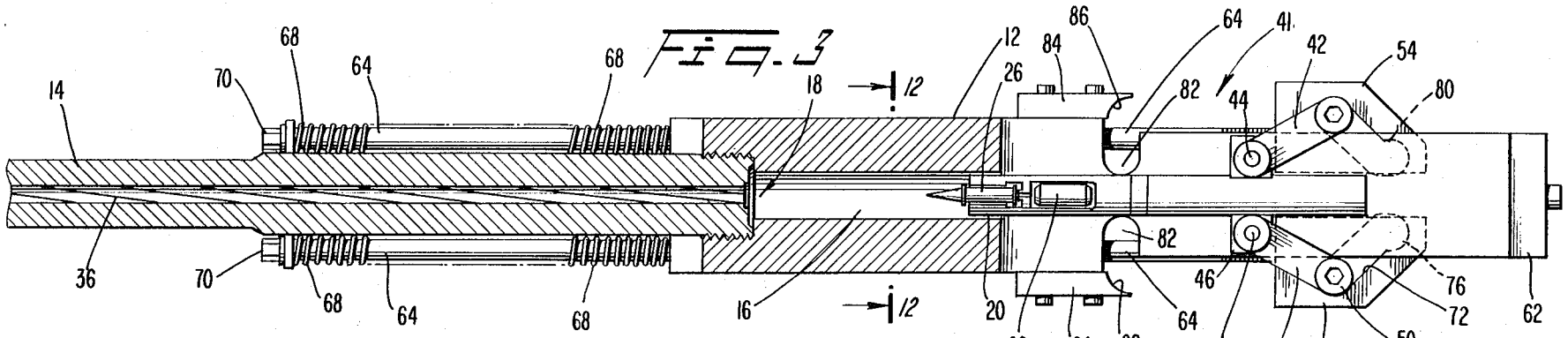
FIG. 3 is a longitudinal sectional view of the machine gun with the bolt in a retracted or cocked position.
Figure 5:
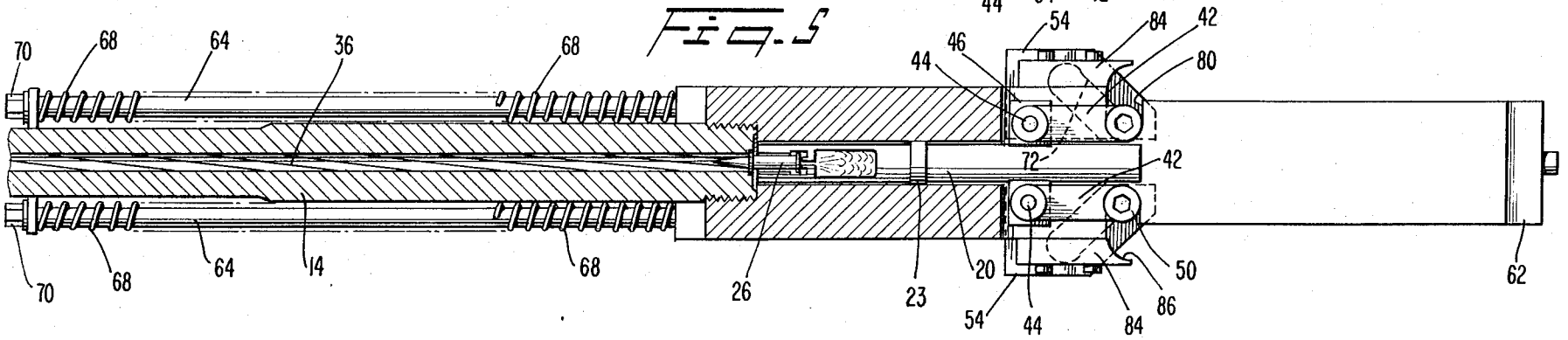
FIG. 5 is a view similar to FIG. 4 after the projectile has been inserted in a firing position.

As described in U.S. Pat. No. 4,282,670, the projectile carries its own primer 33 (FIG. 11) which is to be ignited by a striker projection 32, the latter comprising an integral part of the bolt. That is, as the bolt 20 is advanced, the striker projection 32 bears against the backside of the projectile 26 in alignment with the primer 33, to push the projectile toward the ignition chamber 18 (FIG. 3). Simultaneously, a wall 34 of the rear recess 24 pushes the propellant charge 28 forwardly. When the projectile enters a bore 36 of the barrel (FIG. 9), a front skirt 38 of the projectile engages a stop shoulder 40 of the receiver (FIG. 5). At this point, further advancement of the bolt and striker projection 32 causes the latter to penetrate and ignite the primer in the projectile. The resulting products of combustion enter the rear recess 24 via passage 30 to ignite the propellant 28 and propel the projectile 26 from the bore.

It will be appreciated that the bolt constitutes a firing pin/bolt in the sense that it performs the traditional functions of a bolt and firing pin. The bolt also performs functions traditionally performed by the metal case of encased ammunition, i.e., it loads (and extracts) all the ingredients of a given round simultaneously and assists in sealing.

Figure 2:
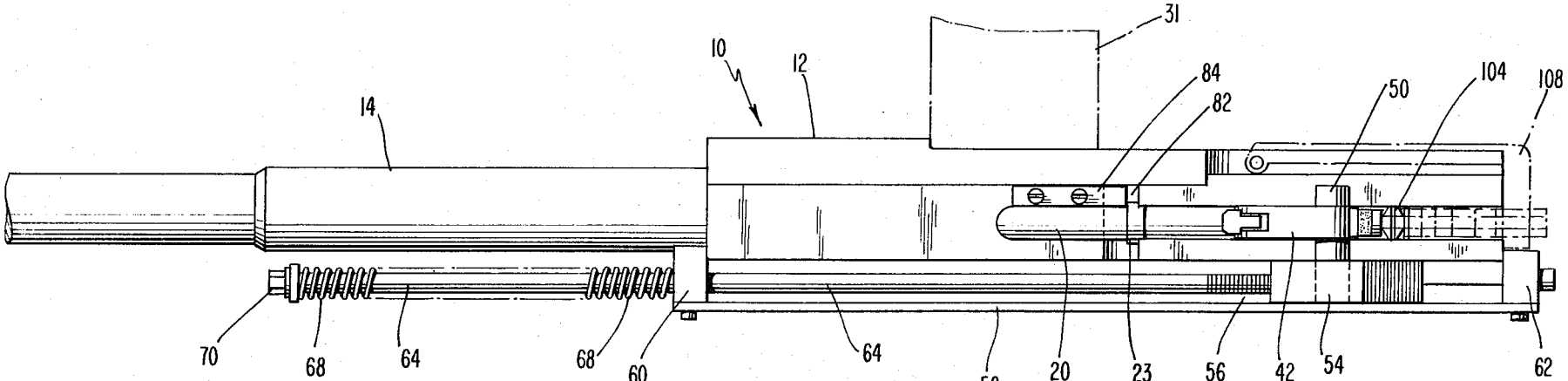
FIG. 2 is a side elevational view of the machine gun depicted in FIG. 1.

In accordance with the present invention, there is provided a mechanism 41 for advancing, locking, and releasing the bolt 20. That mechanism 41 comprises a pair of arms 42, (FIGS. 3, 6) pivotably mounted at their forward ends by means of pins 44 to brackets 46 projecting radially outwardly from a rearward extension of the bolt 20. The arms are mounted for rotation about the axes of the pins which are oriented perpendicularly relative to the bolt 20, such that rearward ends of the arms travel toward or away from the bolt as the arms swing about their axes. The arms extend rearwardly and outwardly through a first radial track 48 (FIG. 2) of the receiver which intersects the central passage 16, whereby outer ends of the arms are situated outside of the receiver 12 (see FIG. 1).

The outer ends of the arms 42 carry cylindrical bosses in the form of pins 50 which are disposed parallel to the axes of rotation of the arms 42. The pins 50 are situated externally of the receiver and are longer than the height of the track 48 so as to engage the sides of the receiver (see FIG. 2). An end of each pin 50 is seated within one of a pair of slots 52 of an actuator member in the form of a plate 54. The plate 54 is mounted for movement parallel to the central passage 16 within a second track 56 which is spaced from the central passage 16. The second track 56 is defined by a metal plate 58 which extends parallel to the receiver and is fixed to front and rear bars 60, 62 that are fixed to the receiver 12.

The actuator plate 54 has threaded holes at its front end which are threadedly connected to the rear ends of a pair of rods 64. Both rods 64 extend parallel to the central passage 16 and pass through openings in the front bar 60. Coil compression springs 68 surround the rods 64 and are constrained between the front bar 60 at one end and threaded nuts 70 at the outer ends of the rods 64. Thus, the springs 68 tend to yieldably urge the rods 64, and thus the actuator plate 54, forwardly. A downward extension 71 of the receiver (FIGS. 9, 10) extends in a fore-aft direction. The actuator plate 54 has a channel 73 which receives the guide block to aid in guiding the plate 54 for movement in a fore-aft direction.

The slots 52 in the actuator plate 54 are inclined relative to the fore-to-aft direction of bolt travel so as to extend forwardly and outwardly relative to the center passage 16, i.e., the slots diverge in the forward direction. Each slot includes a first (a rear) cam surface 72 and a second (or front) cam surface 74 extending parallel to each other and to the longitudinal axis of the slot. At its rear end each slot includes a rounded pocket 76 which is offset rearwardly relative to the slot such that a stop surface 80 is formed for reasons to be explained hereinafter.

It will be appreciated that as the actuator plate 54 travels forwardly, each pin 50 bears against the rear cam surface 72 of its associated slot 52. Thus, this rear cam surface 72 of the slot exerts a force against the pin which has components in the longitudinally forward direction as well as in the radially inward direction. Since the pin 50 bears against the side of the receiver, it is unable to travel radially inwardly and is thus constrained to travel forwardly. In so doing, the arms 42 push the bolt 20 forwardly toward the ignition chamber 18.

The receiver includes a pair of opposed lateral grooves 82 (FIG. 1) which are formed at opposite sides of the receiver. The grooves 82 include front and rear side walls 83, 85 which intersect the track 48 in which the actuator plate 54 travels. These walls 83, 85 extend substantially perpendicularly to the fore-aft axis of the receiver. As the forwardly traveling pins 50 reach outer ends of the grooves the radially (laterally) inward forces imposed by the rear cam surfaces 72 of the slots 52 push the pins laterally into the grooves and toward the fore-aft axis. A pair of deflector fingers 84 are disposed in the path of travel of the pins 50 and include a pair of arcuate cam faces 86 curved inwardly toward the grooves 82 to aid in directing the pins 50 into the grooves.

The relationship between the arms 42 and grooves 52 is such that when the bolt 20 has pushed the projectile 26 forwardly against the stop shoulder 40, the pins 50 are aligned with the respective grooves 52.

Radial inward movement of the pins is induced by the inclined back surfaces of the slot which continuously cam the pins inwardly. It will be appreciated that as the pins 50 thereafter travel radially inwardly within the grooves 52 and the arms 42 approach a parallel relationship with the center passage 16, the pivot axes of the arms 42 are slightly advanced. During this slight advancement, the striker projection 32 is pushed into the primer of the projectile to ignite same. When the pins 50 reach their inner position, they are received in the pockets 76.

At the instant of ignition, the bolt 20, the arms 42, and the pins 50 are urged rearwardly by the ignition pressure. Such rearward urgings are resisted by the engagement between the pins 50 and the rear walls 85 of the grooves 82. Egress of the pins 50 from the grooves is resisted by the stop surfaces 80 of the pockets 76 in the actuating plate 54.

Figure 9:
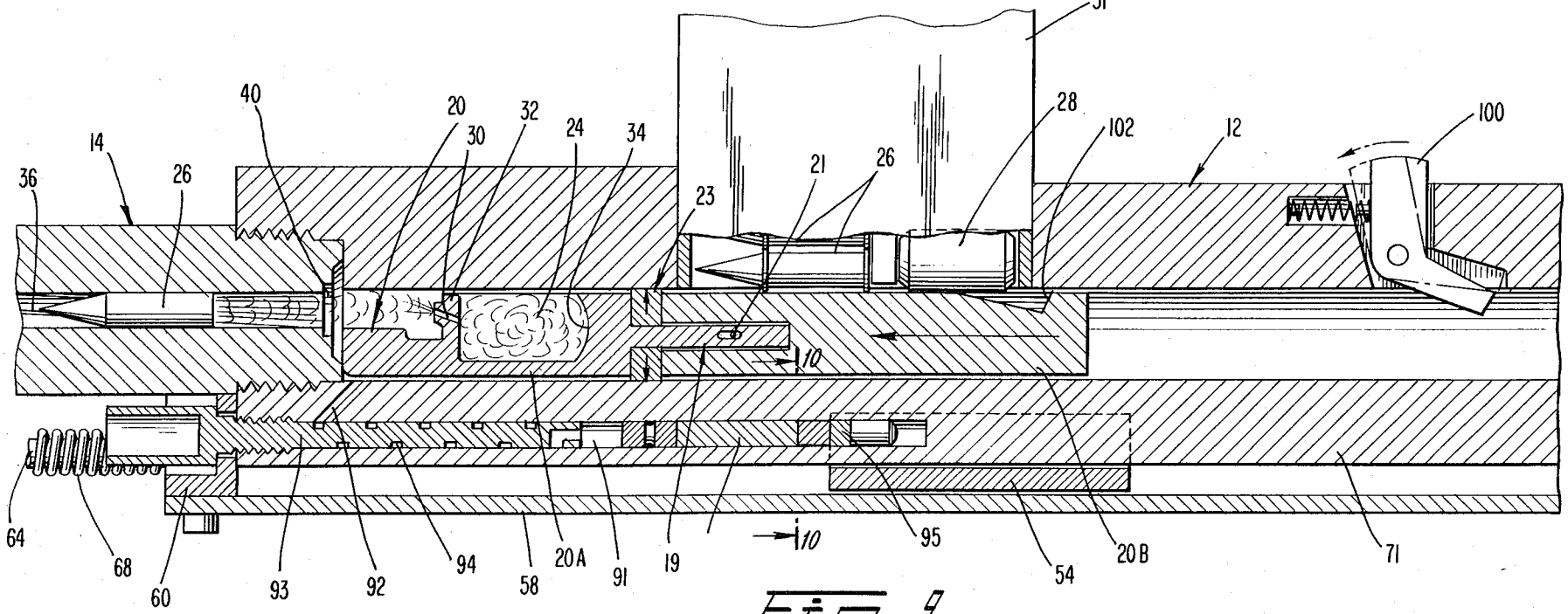
FIG. 9 is a view similar to FIG. 8, at the instant of ignition.

Unlocking of the bolt can be performed by any suitable mechanism. For example, there can be provided a mechanism similar to that disclosed in U.S. Pat. No. 1,387,889. Such a mechanism is depicted in FIG. 9, and includes a piston 90 mounted reciprocably within a bore 91 of the extension 71 of the receiver. The bore 91 communicates with the firing chamber 18 by means of a bleed passage 92. A gas plug 93 is disposed within the bore 91 and includes a spiral groove which conducts the products of combustion from the bleed passage 92 to the piston 90. As a result, the piston 90 is displaced rearwardly. The piston carries a pair of pusher arms 95 (FIG. 10) which extend into the path of the actuator plate 54 so as to abut the actuator plate 54 and pushes the latter rearwardly. As the actuator plate 54 is pushed rearwardly, the stop surfaces or shoulders 80 are moved out of motion-blocking relationship with the pins 50, and the inclined front surfaces 74 of the slots 52 engage the pins 50 and cam them outwardly. The pins 50 are moved outwardly within the grooves 82 until the rearward forces acting upon the bolt 20 and arms 42 are able to kick the pins 50 out of the grooves 82. Thereafter, the bolt 20 and arms 42 push the actuator plate 54 rearwardly to recock the springs 68.

It will be appreciated that relatively little force is needed to displace the pins 50 from their locked position and thereby effect a smooth and rapid recycling of the bolt 20.

A suitable trigger mechanism 100 (FIG. 9) can be provided to retain the actuator plate in its rearward position, with the springs 68 in a cocked (compressed) condition. The trigger can be mounted in any suitable fashion, such as to an extension of the receiver, or to a carrier on which the receiver is affixed. The trigger 100 is engageable with a recess 102 in a rear extension of the bolt.

Disposed in a rear end of the central passage 16 is a buffer mechanism (FIG. 2) comprising a series of belleville washers 104 mounted on a shaft 106. A hinged gate 108 mounted at the rear of the receiver carries the bolt 20.

Figure 4:
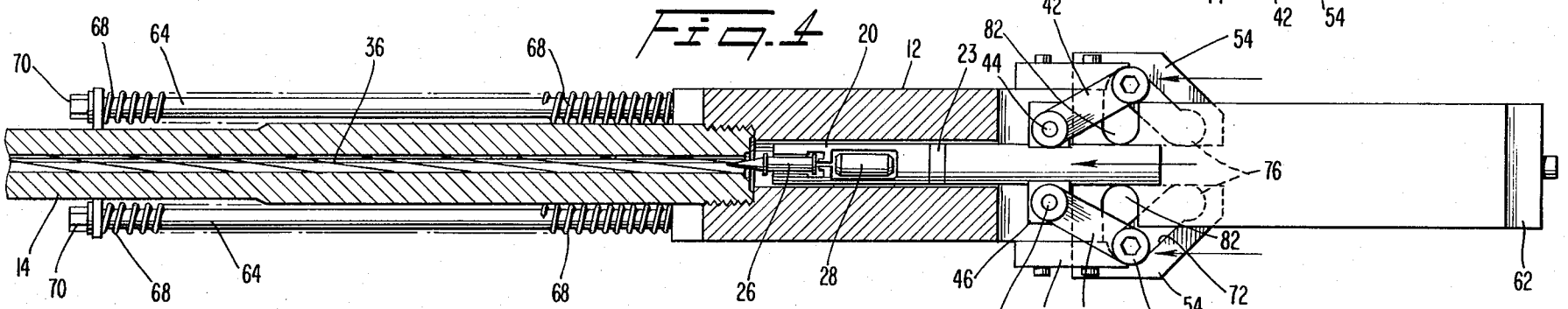
FIG. 4 is a view similar to FIG. 3 as the bolt is being advanced.

In a cocked condition of the firearm (FIGS. 1, 2, 3 and 8) the actuating plate 54 holds the bolt 20 in a rearward position, by virtue of the connection therebetween by means of the arms 42 and the bosses or pins 50. The coil compression springs 68 are held in a compressed state. When a projectile and propellant charge have been loaded into the firearm, and the actuating plate 54 is released, the springs 68 pull the actuating plate forwardly. In so doing, the rear cam surfaces 72 push the pins 50 forwardly whereby the arms push the bolt forwardly (FIG. 4).

Figure 6:
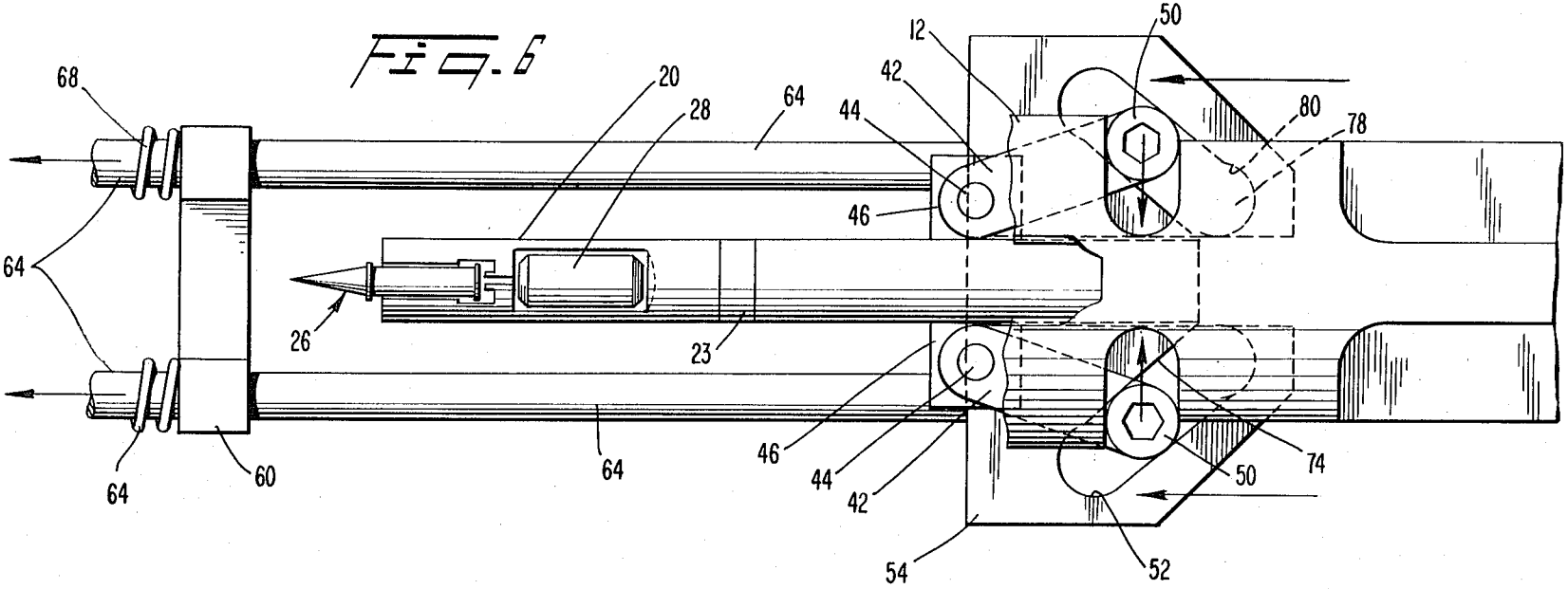
FIG. 6 is a view of a bolt actuating mechanism of the machine gun, with a portion of the receiver not depicted for clarity, depicting the condition where the bosses have reached the lateral grooves in the receiver.
Figure 7:
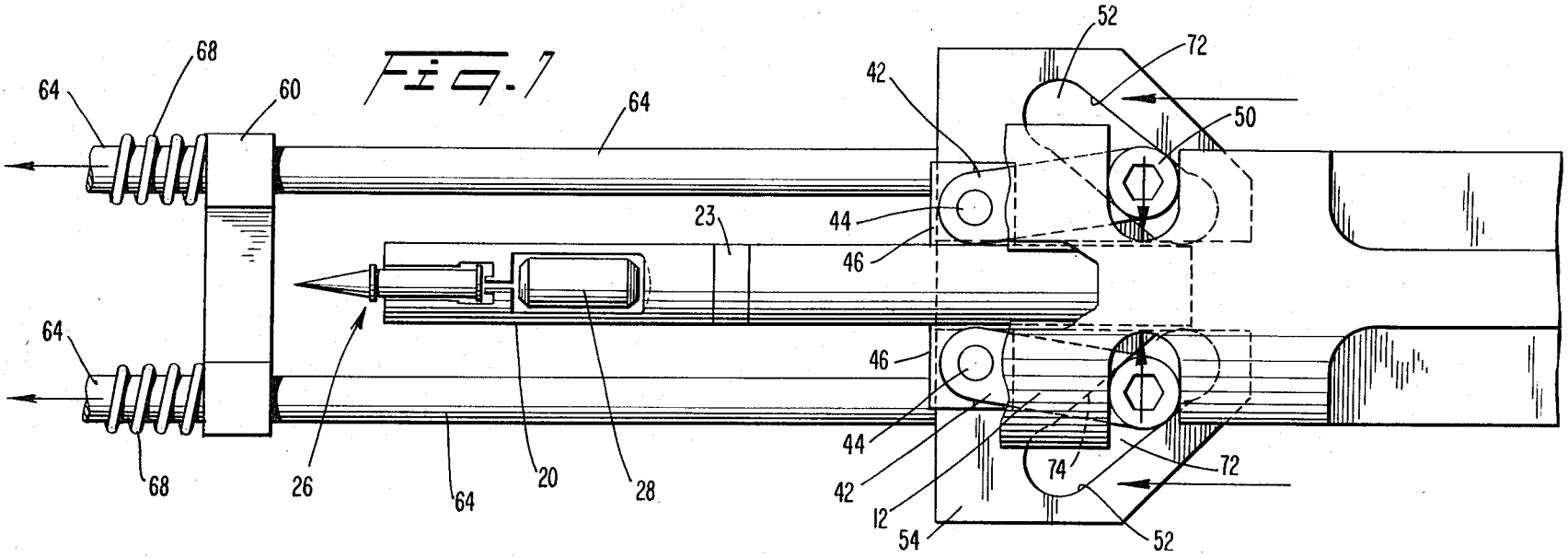
FIG. 7 is a view similar to FIG. 6 after the bosses have been partially displaced laterally so as to further advance the bolt.
Figure 4:
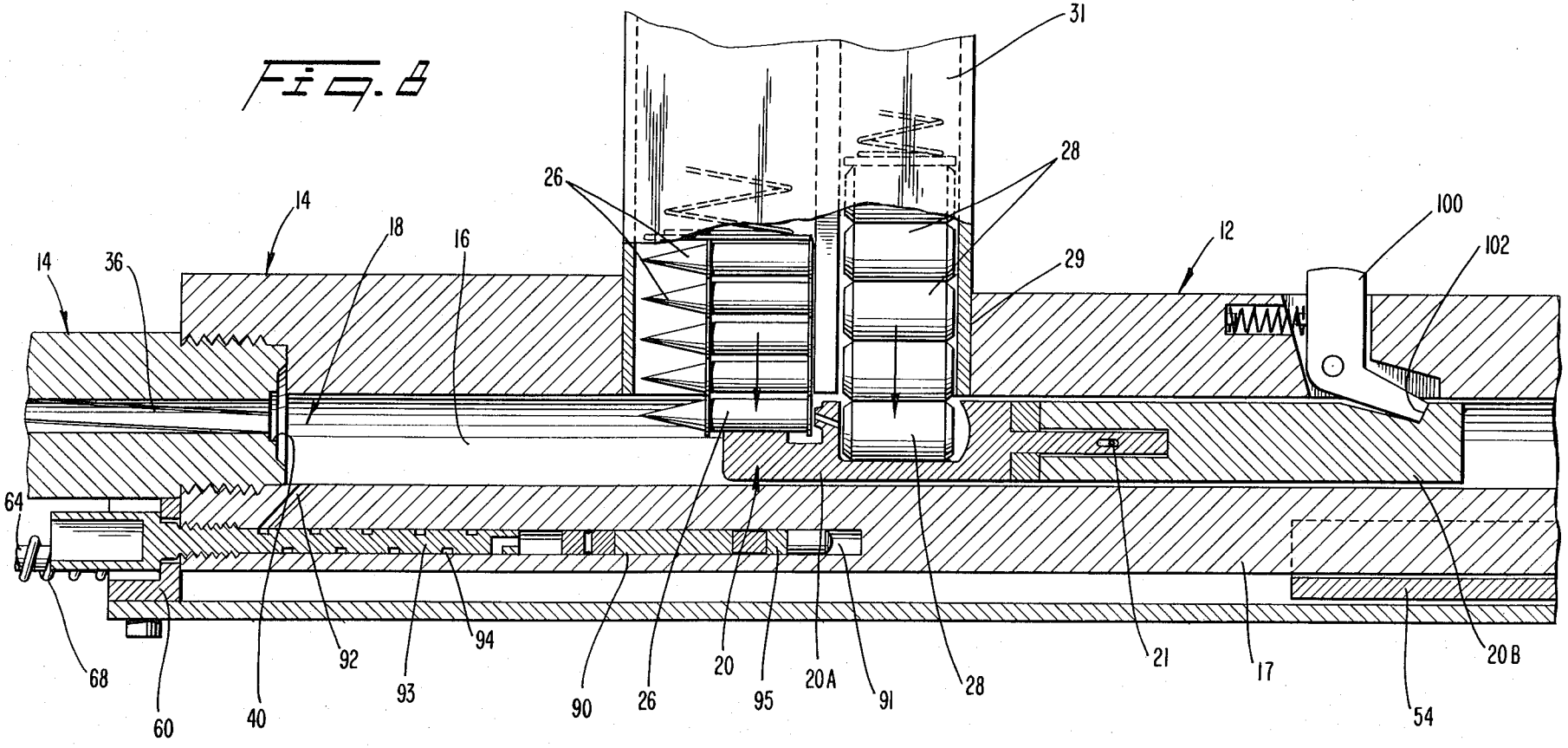
Figure 7:
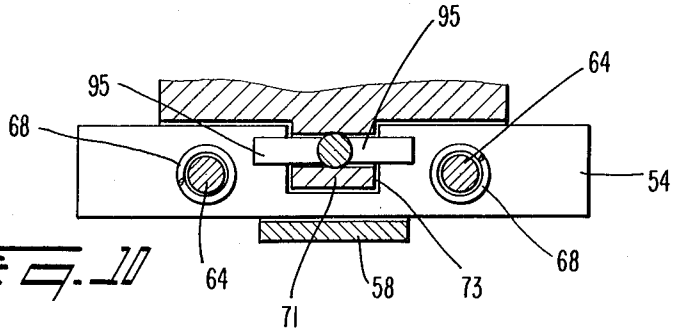

When the projectile reaches a firing position, wherein the skirt 38 of the projectile engages the stop shoulder 40 of the receiver (FIG. 5), the pins 50 will be located at the mouths or inlets of the grooves 82 in the receiver, as depicted in FIG. 6. Further advancement of the actuator plate 54 results in the rear cam surfaces 72 camming the pins 50 laterally inwardly along the grooves 82. As the pins 50 travel laterally, the arms 42 approach a condition parallel to the fore-aft axis of the firearm. Accordingly, the front ends of the arms are slightly advanced (compare FIGS. 6 and 7), thereby further advancing the bolt and its striker projection 32 relative to the projectile. As a result, the striker projection ignites the primer in the projectile, whereupon the propellant charge 28 is ignited to expel the projectile from the barrel. The initial recoil effects of the ignition cannot force the pins 50 from the grooves 82, since the stop surfaces or shoulders 80 of the pockets 76 prevent any lateral outward movement of the pins. Thus, it is assured that premature recoiling will not occur, and that the full effects of combustion will be imparted to the projectile.

When the actuator plate 54 is retracted slightly, by means of the piston 90, the front cam surfaces 74 of the slots 52 cam the pins 50 laterally outwardly, whereupon the residual combustion pressures acting against the bolt cause the pins 50 to be ejected from the grooves 82, whereupon the bolt 20 is shifted to its retracted or cocked position (depicted in FIG. 9). In so doing, the springs 68 become cocked preparatory to a subsequent firing sequence.

The firearm disclosed herein is preferably employed as a support-mounted machine gun.

It will be appreciated that the present invention enables the primer to be ignited, and the bolt locked, without the danger that ignition will occur before locking takes place, or that the bolt will be prematurely retracted following ignition.

Although the present invention has been described in connection with preferred embodiments thereof, it will be appreciated by those skilled in the art that additions, modifications, substitutions, and deletions not specifically described, may be made without departing from the spirit and scope of the invention, as defined in the appended claims.

We claim:

1. A firearm comprising:

housing means defining a barrel bore, an ignition chamber communicating with a rear end of said bore, and a shoulder arranged to terminate forward travel of a projectile in said ignition chamber, bolt means slidable along a fore-aft axis in said ignition chamber and including a striker projection for displacing the projectile into a firing position against said shoulder, a forward stroke of said bolt means being of such length that said bolt means and said striker projection continue to travel after the projectile is stopped by said shoulder so that said striker projection ignites a primer of the projectile in response to further forward movement of said bolt means against the stopped projectile, means for advancing said bolt means comprising:

arm means having a first end mounted on said bolt means for rotation such that a second end of said arm means is movable laterally inwardly relative to and toward said fore-aft axis, a boss carried at said second end of said arm means, an actuator member being movable in said fore-aft direction and including:

a first cam surface inclined at an acute angle relative to said fore-aft axis for urging said boss forwardly and laterally inwardly against a side of said housing means rearward of said shoulder to advance said boss and said bolt means forwardly, said boss being movable laterally inwardly along said first cam surface in response to said boss becoming aligned with a lateral groove in said side of said housing means such that said first end of said arm means is moved forwardly to push said bolt means and its striker projection forwardly to ignite the projectile, and a stop surface extending rearwardly from an end of said cam surface, and means urging said actuator member forwardly for:

pushing said boss and bolt means forwardly to shift the projectile to said firing position, camming said boss laterally inwardly into said groove to further displace said bolt means forwardly and ignite the primer, and moving said stop surface into blocking relationship with said boss to block movement of said boss out of said groove.

2. A firearm according to claim 1, wherein said groove extends laterally inwardly perpendicularly toward said fore-aft direction, and said second end of said arm means is disposed rearwardly of said first end thereof.

3. A firearm according to claim 1, wherein said first cam surface comprises a portion of a slot within which said boss is movably mounted, said slot including a second cam surface arranged forwardly of and generally parallel to said first cam surface, and means for moving said actuator member rearwardly subsequent to ignition of said primer to push said second cam surface against said boss to cam said boss in a direction out of said groove.

4. A firearm according to claim 3, wherein said stop surface is defined by a curved pocket at an end of said slot, said pocket being offset relative to said slot.

5. A firearm according to claim 1, wherein said means for advancing said bolt means comprises an additional arm means having a first end mounted on said bolt means for rotation such that a second end of said additional arm means is movable laterally inwardly relative to and toward said fore-aft axis, an additional boss carried at said second end of said additional arm means, and said actuator including an additional first cam surface inclined at an acute angle relative to said fore-aft axis for urging said additional boss forwardly and laterally against an additional side of said housing means rearward of said shoulder to advance said additional boss and said bolt means, said additional boss being movable laterally inwardly along said additional first cam surface in response to said boss becoming aligned with an additional lateral groove in said additional side of said housing means such that said first end of said additional arm means is moved forwardly to push said bolt means and its striker projection forwardly to ignite the projectile.

6. A firearm according to claim 1, including deflector means on said housing means for deflecting said boss into said groove.

7. A firearm according to claim 1, wherein said boss travels outside of said housing means and bears against a side thereof.

8. A firearm according to claim 1, wherein said groove includes a pair of lateral walls extending perpendicular to said fore-aft direction.

9. A firearm according to claim 1, wherein said means urging said actuator member forwardly comprises a spring.

10. A firearm comprising:

housing means defining a barrel bore, an ignition chamber communicating with a rear end of said bore, and a shoulder arranged to terminate forward travel of a projectile in said ignition chamber, bolt means slidable along a fore-aft axis in said ignition chamber and including a striker projection for displaced said projectile into a firing position against said shoulder, a forward stroke of said bolt means being of such length that said bolt means and said striker projection continue to travel after the projectile is stopped by said shoulder so that said striker projection ignites a primer of the projectile in response to further forward movement of said bolt means against the stopped projectile after the projectile is in said firing position, and means for advancing said bolt means comprising:

an arm having a forward end mounted on said bolt means for rotation such that a rear end of said arm is movable toward and away from said fore-aft axis, a boss carried at said rear end of said arm, an actuator member movable forwardly and rearwardly relative to said bolt means, said actuator member including a slot in which said boss is received, said slot including:

a back cam surface inclined at an acute angle relative to said fore-aft axis for urging said boss forwardly and inwardly toward said axis and against a side of said housing means rearward of said shoulder as said actuator member moves forwardly, to advance said boss and said bolt means, said slot permitting inward travel of said boss in response to said boss becoming aligned with an inwardly directed groove in said side of said housing means, such that said forward end of said arm is moved forwardly to push said bolt means and its striker projection forwardly to ignite the projectile, a stop surface extending rearwardly from an inner end of said back surface, and a front cam surface extending generally parallel to said back surface, means urging said actuator member forwardly for:

pushing said boss and bolt means forwardly to shift the projectile to said firing position, camming said boss into said groove to displace said bolt means further forwardly and ignite the primer, moving said stop surface forwardly into blocking relationship with said boss to block outward movement of said boss, and means for moving said actuator member rearwardly subsequent to ignition to move said stop surface out of said blocking relationship and push said front cam surface against said boss to cam said boss outwardly of said groove.

* * * * *